US008382304B2

(12) United States Patent
Wegener et al.

(10) Patent No.: US 8,382,304 B2
(45) Date of Patent: Feb. 26, 2013

(54) DISHWASHER

(75) Inventors: Dirk Wegener, Bielefeld (DE); Seyfettin Kara, Spenge (DE)

(73) Assignee: Miele & Cie. KG, Guetersloh (DE)

( * ) Notice: Subject to any disclaimer, the term of this patent is extended or adjusted under 35 U.S.C. 154(b) by 180 days.

(21) Appl. No.: 13/039,334

(22) Filed: Mar. 3, 2011

(65) Prior Publication Data

US 2011/0215689 A1 Sep. 8, 2011

(30) Foreign Application Priority Data

Mar. 8, 2010 (DE) ..... 10 2010 015 849

(51) Int. Cl.
*A47L 9/30* (2006.01)

(52) U.S. Cl. ..... 362/91; 362/96; 362/458

(58) Field of Classification Search ..... 362/89, 362/91, 96, 253, 458, 800
See application file for complete search history.

(56) References Cited

U.S. PATENT DOCUMENTS

| | | | |
|---|---|---|---|
| 2006/0158882 | A1 | 7/2006 | Klomp et al. |
| 2008/0099059 | A1 | 5/2008 | Baumgartner et al. |
| 2009/0044846 | A1 | 2/2009 | Rosenbauer et al. |
| 2010/0033949 | A1 | 2/2010 | Hering et al. |

FOREIGN PATENT DOCUMENTS

| | | | |
|---|---|---|---|
| DE | 1 051 234 | B | 2/1959 |
| DE | 000010236211 | A1 | 2/2004 |
| DE | 000010256168 | A1 | 6/2004 |
| DE | 102004051174 | A1 | 5/2006 |
| DE | 202006006188 | U1 | 8/2007 |
| DE | 202006007151 | U1 | 9/2007 |
| DE | 202008000195 | U1 | 4/2008 |
| DE | 102007017273 | A1 | 10/2008 |
| DE | 102007021123 | A1 | 11/2008 |
| DE | 202008011548 | U1 | 1/2010 |
| DE | 202008011549 | U1 | 1/2010 |
| JP | 2007097804 | A | 4/2007 |
| JP | 2007244639 | A | 9/2007 |
| WO | WO 2004/023033 | A1 | 3/2004 |

*Primary Examiner* — Jason Moon Han
(74) *Attorney, Agent, or Firm* — Leydig, Voit & Mayer, Ltd.

(57) ABSTRACT

A dishwasher includes a housing having a washing chamber with an access opening. An access door is operable to close the access opening in a fluid tight manner. A movable loading unit is disposable in the washing chamber and is at least partially removable from the washing chamber through the access opening. The loading unit includes an illumination device.

13 Claims, 2 Drawing Sheets

DISHWASHER

CROSS REFERENCE TO RELATED APPLICATIONS

This application claims priority to German Patent Application No. DE 10 2010 015 849.6, filed Mar. 8, 2010, which is hereby incorporated by reference herein in its entirety.

FIELD

The present invention relates to a dishwasher including a housing defining a washing chamber, said washing chamber having an access opening which can be closed by an access door in a fluid-tight manner, and accommodating a loading unit which can at least partially be moved out of the washing chamber through the access opening.

BACKGROUND

DE 10 2007 017 273 A1 describes a water-using household appliance, in particular in the form of a dishwasher, which has light sources arranged at a housing edge defining the access opening of the washing chamber. These light sources serve to illuminate the washing chamber. Illuminating the washing chamber advantageously makes it easier to work inside the dishwasher; i.e., within the washing chamber, for example, for purposes of cleaning the washing chamber or refilling the salt and rinse aid reservoirs.

The actual process of loading and unloading the dishwasher is not affected by an illumination device as described in DE 10 2007 017 273 A1. This is due to the construction of the dishwasher, because the racks that hold the dishes are pulled out of the washing chamber of the dishwasher when performing loading and unloading operations in the intended manner. Consequently, the illumination of the washing chamber does not help in a normal loading and/or unloading process.

SUMMARY

In an embodiment, the present invention provides a dishwasher including a housing having a washing chamber with an access opening. An access door is operable to close the access opening in a fluid tight manner. A movable loading unit is receivable in the washing chamber and is at least partially removable from the washing chamber through the access opening. The loading unit includes an illumination device.

BRIEF DESCRIPTION OF THE DRAWINGS

Exemplary embodiments of the present invention are described in more detail in the following description in connection with the drawings, in which.

DETAILED DESCRIPTION

Figure 1:
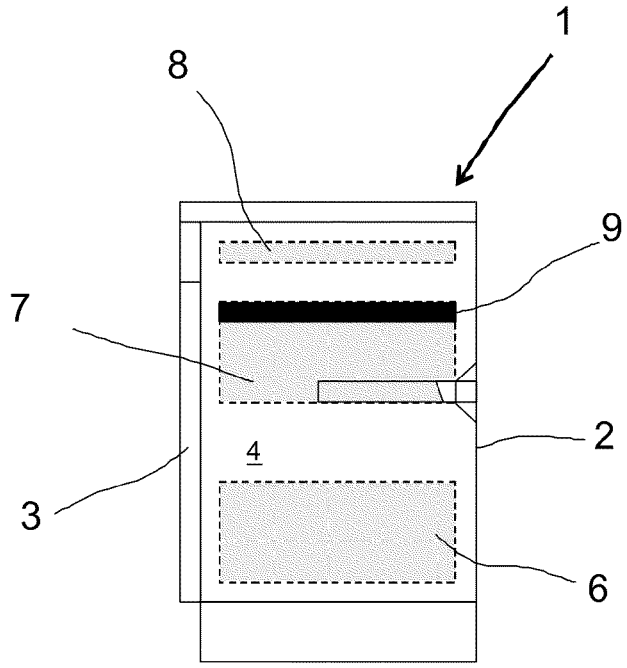
FIG. 1 is a schematic side view of a dishwasher with an access door in a closed position.

In an embodiment, the present invention provides a dishwasher including a washing chamber having an access opening which can be closed by an access door in a fluid-tight manner, and a loading unit which can at least partially be moved out of the washing chamber through the access opening, and that provides increased ease of loading and unloading.

The term "loading unit" as used in the context of the present invention refers to a rack or a cutlery tray of a dishwasher, it being understood that the rack may be either an upper or lower rack.

In order to load and/or unload a dishwasher in the intended manner, the corresponding loading unit is moved out of the washing chamber of the dishwasher through the access opening thereof. When the loading unit is in this extended position, a user can load and/or unload the dishwasher in the intended manner. Once this process is complete, the user pushes the loading unit back into the washing chamber of the dishwasher and closes the access opening in a fluid-tight manner using of the access door of the dishwasher.

In accordance with an embodiment of the present invention, the loading unit is provided with an illumination device. The loading unit may be the lower rack, the upper rack, or also the cutlery tray of the dishwasher, as the case may be.

The design of the present invention has the advantage that the illumination device of the loading unit provides illumination of the loading unit and that, in contrast to conventional systems, it does so also when the loading unit has been pulled-out of the washing chamber of the dishwasher to allow loading and/or unloading to be performed in the intended manner. This makes it easier for the user of the dishwasher to load and/or unload the loading unit, especially when there is no ambient lighting. In addition, the illumination device disposed on the loading unit can enable the user to check the washing result at the end of a dishwashing cycle more easily than was possible heretofore. The illumination device illuminates the dishes supported in the loading unit, allowing the washing result to be checked without having to remove the dishes from the loading unit.

In an embodiment, the illumination device of the present invention can include a plurality of light sources. For example, LEDs can be used as light sources, which may be preferable because of the low power consumption and the relatively small space they occupy when installed. Of course, other light sources may also be used. In an embodiment, most of the light sources are arranged on the loading unit in such a way that the loading unit is illuminated in the desired manner, preferably such that it is completely illuminated.

In an embodiment, the illumination device of the present invention has a rechargeable energy storage device. This energy storage device may be a capacitor or a storage battery. The rechargeable energy storage device allows the illumination device to be used independently of the power supply of the dishwasher. The illumination device is capable of operating autonomously, which can eliminate the need to provide power supply cables for the light sources of the illumination device, which cables might have to be capable of moving in and out along with the loading unit.

In an embodiment, charging of the energy storage device can be accomplished using a contactlessly operating charging device. This charging device can include a coil arrangement including a primary coil and a secondary coil, the primary coil being located outside of the washing chamber, and the secondary coil being disposed on the loading unit. The primary and secondary coils are matched such that the energy storage device is charged via the coil arrangement when the loading unit is in the retracted position; i.e., when the loading unit has been moved into the washing chamber of the dishwasher in the intended manner. Charging does not occur when the loading unit is in the extended position.

In an embodiment, the dishwasher has a detection circuit for detecting the position of the loading unit. This detection circuit can be easily implemented via the determination of the load current of the primary coil. The detection circuit may be used to cause the illumination device disposed on the loading unit to be automatically turned on and off. The illumination device can be turned on before the loading unit is fully extended from the washing chamber. This allows a user of the dishwasher to check early whether the loading unit is completely full or whether there is still space available in the rack to accommodate dishes. In this context, "early" means without having to pull the loading unit fully out of the washing chamber.

In an embodiment of the present invention, the detection circuit may be combined with, for example, a tilt sensor for the access door. Of course, it is also possible to use such a sensor alone. For example, when using a tilt sensor, it is possible to detect the opening angle of the access door relative to the housing of the dishwasher. Provision may be made for the illumination device of the present invention to be automatically turned on when the opening angle exceeds a predetermined value. The sensor used may be an acceleration sensor or a speed sensor capable of detecting a rotational movement; i.e., an opening movement, of the access door.

Figure 2:
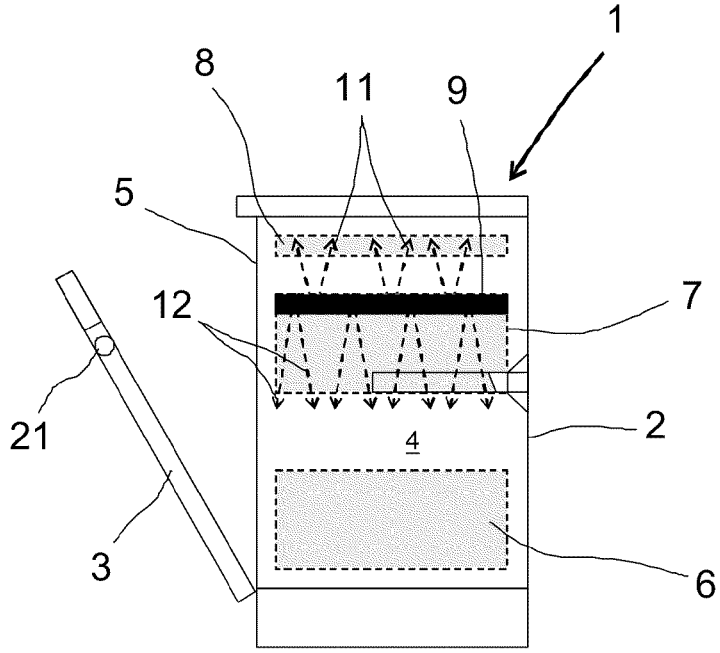
FIG. 2 is a schematic side view of a with an access door in an open position.
Figure 3:
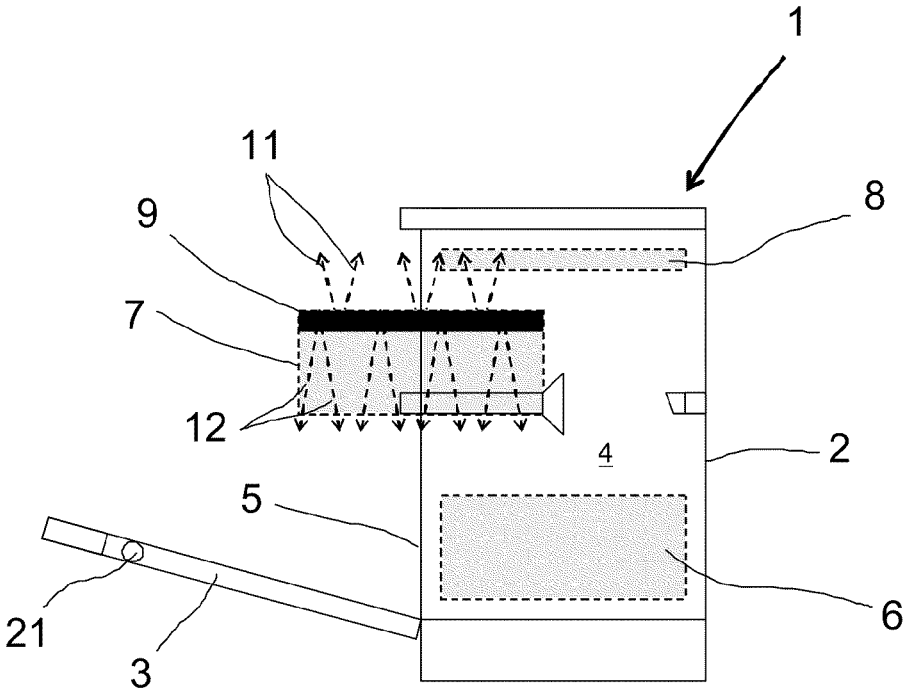
FIG. 3 is a schematic side view of a dishwasher with the access door in an open position and with the upper rack partially extended.

FIGS. 1, 2 and 3 show, in a schematic side view, a dishwasher 1 according to an embodiment of the present invention. Dishwasher 1 includes a housing 2 defining a washing chamber 4. Washing chamber 4 is accessible through an access opening 5 which can be closed in a fluid-tight manner by means of an access door 3 pivotably mounted to housing 2.

In the exemplary embodiment shown, washing chamber 4 accommodates three independently usable loading units, namely a lower rack 6, an upper rack 7, and a cutlery tray 8. Upper rack 7, lower rack 6, and cutlery tray 8 are adapted to be movable and may be pulled out from washing chamber 4 for purposes of loading and/or unloading. During a normal wash cycle, the loading units are located within washing chamber 4, and access opening 5 is closed by access door 3, as can be seen in the view of FIG. 1.

In order to improve and simplify the loading of dishwasher 1, an illumination device 9 is disposed on upper rack 7. When upper rack 7 is in the retracted position, this illumination device is used to illuminate the interior of dishwasher 1; i.e., washing chamber 2, as is shown in FIG. 2. Since illumination device 9 is disposed on upper rack 7, the loading area of upper rack 7 is also illuminated when it has been moved out of washing chamber 4 of dishwasher 1, as can be seen in the view of FIG. 3. Therefore, not only can washing chamber 4 be illuminated when upper rack 7 is in the retracted position, but, in contrast to conventional dishwasherst, upper rack 7 is illuminated as well, and in particular also when upper rack 7 has been moved out of washing chamber 4 of dishwasher 1. This advantageously facilitates the loading and unloading of upper rack 7.

Figure 4:
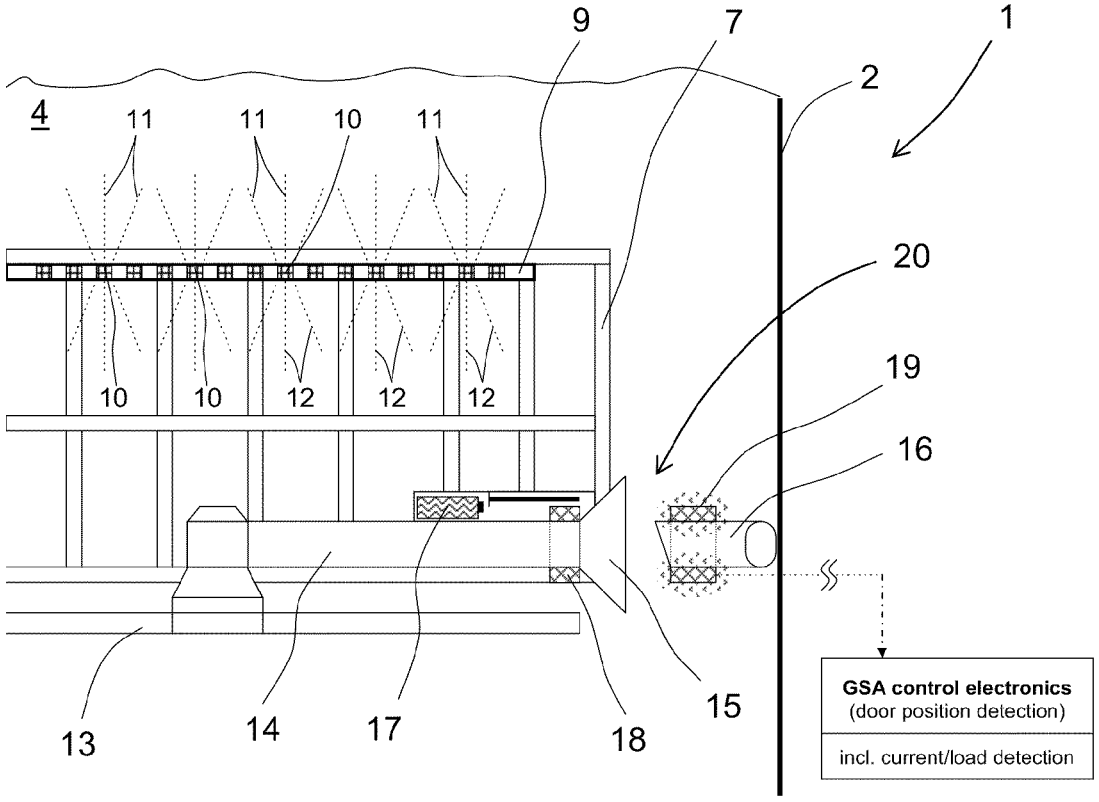
FIG. 4 is a schematic detail view of a loading unit of a dishwasher.

Illumination device 9 includes a plurality of light sources, which may be in the form of LEDs 10. These light sources may be arranged on both the left and right sides of upper rack 7, as viewed in the direction of extension and retraction of the same. In the view of FIG. 4, this is shown for the left side of upper rack 7, as viewed in the direction of retraction and extension. LEDs 10 are arranged in such a way that cones of light represented by arrows 11 and 12 are emitted both upwardly toward cutlery tray 8 and downwardly toward lower rack 6, as viewed in the figures. As a result, washing chamber 4 is uniformly illuminated when upper rack 7 is in the retracted position as shown in FIG. 2. When upper rack 7 is in the extended position, the loading area provided by upper rack 7 is illuminated.

Illumination device 9 has an energy storage device 17, for example in the form of a rechargeable battery. As can be seen particularly in the view of FIG. 4, this rechargeable battery is disposed on upper rack 7, so that LEDs 10 can be autonomously powered by energy storage device 17. Charging of energy storage device 17 is accomplished using a charging device 20. This charging device 20 includes a coil arrangement including a primary coil 19 and a secondary coil 18, which advantageously allows for contactless charging of energy storage device 17.

FIG. 4 shows an exemplary embodiment of charging device 20.

A spray arm 13 is disposed below upper rack 7 and attached to the end of a water conduit 14. At the other end, conduit 14 has a connector 15 for coupling to a water supply conduit 16. When upper rack 7 is in the fully retracted position, as shown by way of example in FIG. 1, conduit 14 is coupled to water supply conduit 16 via connector 15, thereby ensuring that water can be supplied to spray arm 13. When extending upper rack 7 from its retracted position, connector 15 detaches from supply conduit 16, causing the two conduits 14 and 16 to be separated from one another. FIG. 4 shows an upper rack 7 which has been moved out of its retracted position.

Charging device 20 has a secondary coil 18. This secondary coil is disposed at conduit 14, which moves along with upper rack 7. Primary coil 19 of charging device 20 is preferably disposed in the region of the wash chamber wall, either inside (as shown) or, more advantageously, outside of washing chamber 4, for example at supply conduit 16.

When used as intended, primary coil 19 generates an electromagnetic field which builds and collapses, inducing an electrical voltage in secondary coil 18, said voltage charging energy storage device 17.

A detection circuit can be provided to detect whether upper rack 7 is in the retracted position. This can be easily be accomplished by determining the load current of primary coil 19. For example, when upper rack 7 is extended; i.e., pulled out of washing chamber 4, for loading, the detection circuit detects this condition and automatically turns on illumination device 9; i.e., LEDs 10 of illumination device 9. In order for the rack illumination to be activated not only when upper rack 7 is in the extended condition, an additional intelligent circuit having a suitable sensor may be provided, for example at upper rack 7 itself or at dishwasher door 3. The sensor used may be, for example, a tilt sensor 21 which detects the position of the dishwasher door; i.e. the opening angle of dishwasher door 3 relative to housing 2 of dishwasher 1. Thus, when a tilt sensor 21 is used, it may be provided that illumination device 9 is only turned on when door 3 has been opened to an angle of at least 45°. Otherwise, illumination device 9 remains off.

In the exemplary embodiment shown in the figures, illumination device 9 is disposed exclusively on upper rack 7. Alternatively, of course, lower rack 6 and/or cutlery tray 8 may also be equipped, or exclusively be equipped, with a corresponding illumination device 9.

While the invention has been particularly shown and described with reference to preferred embodiments thereof, it will be understood by those skilled in the art that various changes in form and details may be made therein without departing from the spirit and scope of the invention.

What is claimed is:

1. A dishwasher comprising:

a housing including a washing chamber having an access opening;

an access door operable to close the access opening in a fluid-tight manner;

a movable loading unit receivable in the washing chamber and at least partially removable from the washing chamber through the access opening, the loading unit including an illumination device with a plurality of LED light sources for illuminating the loading unit to increase ease of loading and unloading.

2. The dishwasher as recited in claim 1, wherein the loading unit includes a rack.

3. The dishwasher as recited in claim 1, further comprising a lower rack, and wherein the loading unit includes an upper rack.

4. The dishwasher as recited in claim 3, further comprising a cutlery tray.

5. The dishwasher as recited in claim 1 wherein the illumination device includes a plurality of light sources.

6. The dishwasher as recited in claim 1, further comprising a rechargeable energy storage device associated with the illumination device.

7. The dishwasher as recited in claim 6, wherein the rechargeable energy storage device includes at least one of a capacitor and a storage battery.

8. The dishwasher as recited in claim 6, further comprising a contactlessly operating charging device configured to charge the energy storage device.

9. The dishwasher as recited in claim 8, wherein the charging device includes a coil arrangement including a primary coil disposed outside of the washing chamber and a secondary coil disposed on the loading unit.

10. The dishwasher as recited in claim 1, further comprising a detection circuit configured to detect a position of the loading unit within the washing chamber.

11. The dishwasher as recited in claim 1, wherein the access door includes a sensor.

12. The dishwasher as recited in claim 11, wherein the sensor is a tilt sensor.

13. A loading unit configured to be disposed in a washing chamber of a dishwasher housing and movable with respect to the housing so as to be at least partially removable from the washing chamber through an access opening of the washing chamber, the loading unit including an illumination device with a plurality of LED light sources for illuminating the loading unit to increase ease of loading and unloading.

* * * * *